United States Patent [19]

Knäpper et al.

[11] Patent Number: 5,040,399

[45] Date of Patent: Aug. 20, 1991

[54] METHOD OF FABRICATING BOX SECTION FROM STEEL WITH WALLS THAT DIFFER IN THICKNESS

[75] Inventors: Klaus Knäpper; Herbert Pollmann, both of Hamm, Fed. Rep. of Germany

[73] Assignee: Hoesch AG, Dortmund, Fed. Rep. of Germany

[21] Appl. No.: 546,106

[22] Filed: Jun. 29, 1990

[30] Foreign Application Priority Data

Jun. 30, 1989 [DE] Fed. Rep. of Germany ..... 3921456

[51] Int. Cl.[5] ..... B21B 1/12

[52] U.S. Cl. ..... 72/200; 72/364; 72/367; 72/377; 72/342.6; 72/342.96; 72/224; 29/897.31; 29/DIG. 24; 29/DIG. 32

[58] Field of Search ..... 72/200, 224, 203, 362, 72/364, 365.2, 366.2, 367, 368, 377, 342.1, 342.2, 342.5, 342.6, 342.94; 29/897, 897.2, 897.31, 897.33, 897.35, DIG. 13, DIG. 24, DIG. 32

[56] References Cited

U.S. PATENT DOCUMENTS

| | | | |
|---|---|---|---|
| 368,622 | 8/1887 | Sandford | 72/368 |
| 1,019,968 | 3/1912 | Koenig | 72/224 |
| 2,085,829 | 7/1937 | Rogers | 29/897.35 |
| 2,780,000 | 2/1957 | Huet | 72/367 |
| 4,220,277 | 9/1980 | Hesse et al. | 72/367 |
| 4,527,411 | 7/1985 | Shinosaki et al. | 72/364 |

FOREIGN PATENT DOCUMENTS

| | | | |
|---|---|---|---|
| 0001413 | 1/1986 | Japan | 72/364 |
| 0584946 | 12/1977 | U.S.S.R. | 72/368 |

*Primary Examiner*—Lowell A. Larson
*Assistant Examiner*—Thomas C. Schoeffler
*Attorney, Agent, or Firm*—Max Fogiel

[57] ABSTRACT

A method of fabricating box section from steel with walls of non-uniform thickness along its periphery. A starting product in the form of round tubing with a wall that is uniformly thick along its circumference is manufactured and rolled into box section with walls of uniform thickness along its periphery. A temperature difference is generated between the flange midsections and the web midsections of the box section with walls of uniform thickness along its periphery such that the flange midsections are at least 600° C. hotter than the web midsections, the flanges are edged and thickened peripendicular to the longitudinal axis of the box section, with the edge length being shortened, by rollers, and the box section is finally cooled with air and/or water subject to standardization conditions.

10 Claims, 2 Drawing Sheets

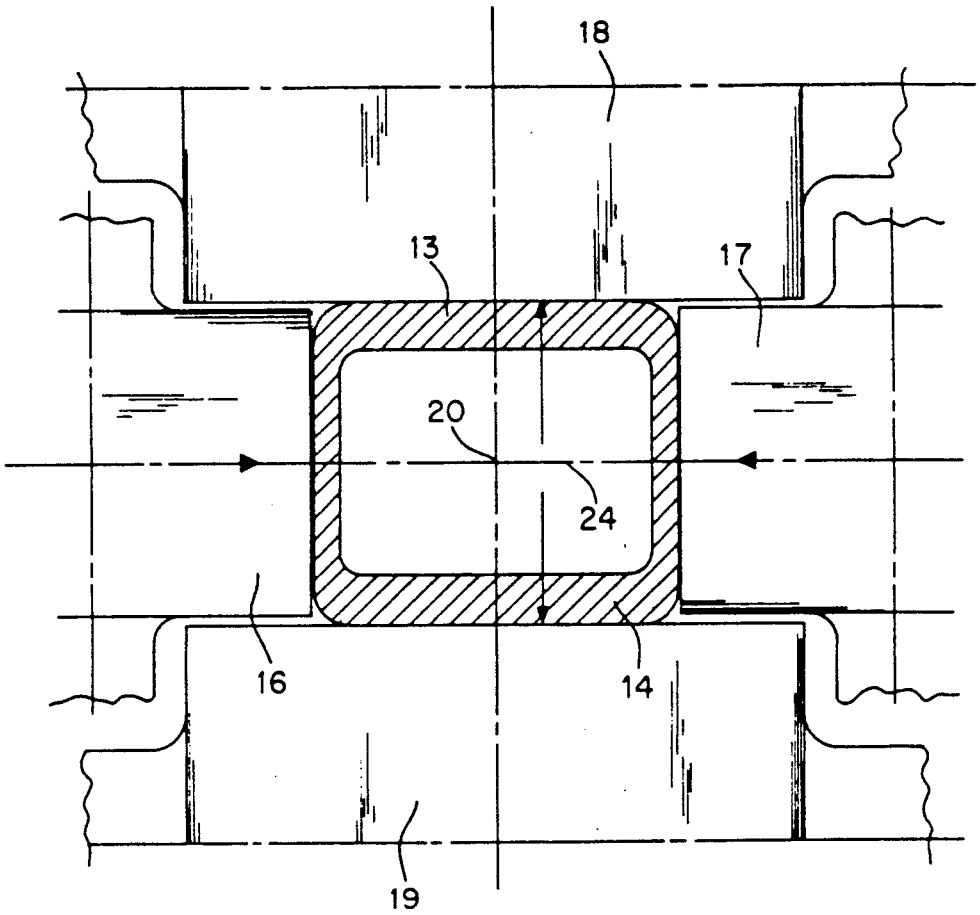
FIG. 2
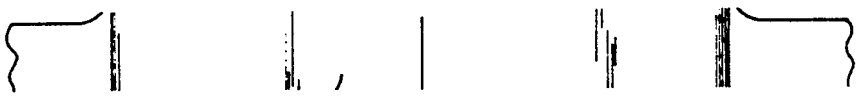

METHOD OF FABRICATING BOX SECTION FROM STEEL WITH WALLS THAT DIFFER IN THICKNESS

BACKGROUND OF THE INVENTION

Box section is known from a very wide range of applications, components of steel-frame architectural structures, machine frames, crane booms, and beams and frames in shipping vehicles for example.

Box section is usually rolled hot or cold from round tubing and features a high load-bearing capacity accompanied by relatively light weight.

Except for slightly thicker areas at the edges, the flanges, or horizontal walls, and the webs, or vertical walls, of such structural section are uniformly thick and accordingly distribute their mass uniformly over the periphery.

When, however, such structural section is employed for tension or compression members or is subject to bending forces in relation to powerful torsion, one drawback of uniformly thin walls, specifically that the section can essentially be supported only by edge elongation, becomes evident.

This drawback in turn considerably affects overall height and restricts the design potential when for example such section is employed for truck axles or as telescoping crane booms.

When, however, increasing bending stress must be accommodated in conjunction with the maximal possible resistance to torsion, it will become necessary not only to elongate the edges and possibly thicken the whole wall uniformly, but also to redistribute the mass around the periphery of the section to ensure that the varyingly thick walls of the flanges and webs will produce an optimal local equatorial moment of inertia in accordance with Steiner's displacement.

The process of manufacturing section of this type is, however, much more complicated than the aforesaid rolling.

Section of this type is usually composed of joined-together sheet metal, with the flanges and webs made of different thicknesses.

Another approach utilizes two L-shaped sections, with the base of each L being thicker than the riser, joined together laterally reversed into box section.

One drawback of both these approaches is that they require a series of several relatively complicated production steps. The L section for example must first be hot-rolled and stretched, subsequent to which two lengths are positioned together laterally reversed and welded with two diametrically opposed longitudinal seams.

The hereby conventional submerged-arc welding proceeds at approximately two or three meters a minute, permanently decelerates production, and necessitates subsequent heat-treatment of the seam to ameliorate undesired alterations in the joint and welding tensions due to the heat of welding and to uncontrolled cooling.

Another method of manufacturing box section with walls that differ in thickness around the periphery is disclosed in European Patent 0 084 799 B1. This section is employed for interiorly cooled tracks for continuous casting and is also rolled from a round tube.

The thickness of the walls is varied in one embodiment disclosed in the European patent either by grinding down one face of a length of finished box section or track to make the wall thinner or by symmetrically rolling tubing with walls that already differ in thickness.

The variation in wall thickness is primarily intended to improve heat transmission for particular applications.

The drawback of the aforesaid grinding process is the expense dictated by the high level of investment in machinery and by the time involved as well as by the large amount of waste that occurs.

The alternative that begins with tubing that already has thicker wall areas on the other hand also involves serious production-technology drawbacks in that on the one hand it is very difficult to manufacture tubing with uniformly symmetrical thicker wall areas and without eccentricity over its total length and in that on the other it is extremely difficult to roll such tubing into rectangular box section and position the thicker areas accurately, whereby the flow of mass is impossible to control during the rolling.

Another method of manufacturing hollow structures with walls of non-uniform thickness is disclosed in German Patent 843 834. Here the generally round tubing with a uniformly thick wall is shaped by hot drawing or hot extrusion. The starting tubing is heated irregularly along its circumference before being drawn to obtain lower temperatures in the areas subjected to high tension during the drawing process than in those subjected to compression.

This approach prevents undesirable constrictions in the wall, at the corners of drawn box section for example, and also makes it possible to produce hollow section with walls of non-uniform thickness. The latter results from a more powerful heating of the areas, the thinner areas in this case, that is, that are more powerfully affected in terms of the final shape, when the hot drawing employs a core.

Although this method does allow control of the wall thickness along the periphery, it does entail the drawbacks of being time-consuming and complicated in that the original tubing must first be completely drawn over the core and then pivoted up in front of the die along with the core and drawn or extruded, subsequent to which the core must be extracted and pivoted back into the lifting position. The use of a core also limits the method to length-by-length manufacture, and it cannot be extended to the continuous production of such section.

The core is also difficult to support, especially when larger section is being manufactured, and all the tracks and pivoting mechanisms are complicated to build and inefficient to operate.

All known methods are also impractical in that they are impossible to integrate into high-speed plants for manufacturing standard section on an industrial scale.

Both the joining and machining and the hot drawing over a core dictate how rapidly a continuous-operation plant can operate and accordingly represent bottlenecks.

SUMMARY OF THE INVENTION

The object of the invention is accordingly a method of fabricating box section with walls of non-uniform thickness that demands only simply and industrially produced tubing or section as a starting material, that does not involve joining or machining, that requires a simple production plant, and that allows redistribution of the volume or mass of standard section "in the billet,"

in both continuous and length-by-length operation, that is.

The concept behind the invention is to initially fabricate round welded or unwelded tubing of uniform wall thickness into box section of uniform wall thickness and then to purposefully redistribute the masses by rolling the section in conjunction with local heat treatment to affect the material strength.

The midsections of the flanges are heated at least 600° C. hotter than the midsections of the webs, and the flanges are edged and thickened by rollers perpendicular to the longitudinal axis of the section while their edge length is shortened.

Once the mass has been deformed and redistributed in this way, the resulting structural section is exposed with its walls differing in thickness to cooling subject to standardization conditions with air and/or water.

Another particular advantage of this approach, in addition to the simplicity with which the mass distribution can be thermally controlled, is that edging and thickening the flanges at high temperatures avoids strain hardening, whereas the processing forces are a fraction of those that occur in conjunction with cold rolling or with drawing.

Strain hardening, especially in the vicinity of the edges, and rolling or fabrication forces can in a practical way be even further minimized if the welded or unwelded for example tubing of uniform wall thickness is initially fabricated in heat, at a fabrication temperature of 900° to 1050° C., that is, and if the difference between the temperature of the flange midsection and the web midsection that is needed later to distribute the mass can be obtained before the section is fabricated into a box section with walls that differ in thickness over the periphery by partially cooling the web midsections to 200° to 450° C. with water and/or air.

To prevent the midsections of the webs from hardening during the partial cooling, it is also practical to initially subject the fox section of uniform wall thickness obtained from the round tubing of uniform wall thickness at a temperature of 900° to 1050° C. to cooling subject to standardization conditions and then to heat the flange midsections to at least 600° C. hotter than the web midsections by partial annealing. The flanges are then edged and thickened again perpendicular to the longitudinal axis of the structural section while decreasing their edge length by rolling.

In appropriate fields of application and with thin walls, accordingly, the resulting savings in thermal energy lead to extensive economical advantages when the welded or unwelded for example tubing is fabricated into box section with uniform wall thicknesses at room temperature, the flange midsections are partially annealed to at least 600° C. hotter than the web midsections, and the further controlled edging and thickening is accomplished by rolling.

All three of the aforesaid processes are especially practical when extensive lots are to be continuously produced in the billet.

When the lots are smaller or when the dimensions of the product are changed rapidly on the other hand, it is practical to vary the method to allow existing section with uniform wall thickness to be obtained from stock and relatively rapidly fabricated into section with non-uniform wall thickness.

This can be done by initially fabricating welded or unwelded for example tubing, either cold or, if applications and manufacturing conditions dictate comprehensive reduction of strain hardening and rolling forces, at a temperature of 900° to 1050° C., followed by standardizing cooling into box section of uniform wall thickness, whereby the billet is trimmed to conventional storing lengths of 6 to 18 meters either before or after, depending on the rate of fabrication, the round tubing is fabricated into box section with walls of uniform thickness over the periphery.

The subsequent fabrication steps can then be postponed until necessary, when the separate lengths are supplied to a rolling mill to purposefully distribute the mass by partially annealing the flange midsections to at least 600° C. hotter than the web midsections.

One embodiment of the invention will now be described in detail with reference to the drawing.

BRIEF DESCRIPTION OF THE DRAWINGS

FIG. 1 is a schematic drawing of a fabrication plant appropriate for carrying out the method and FIG. 2 is a section through an edger appropriate for controlled mass distribution.

DESCRIPTION OF THE PREFERRED EMBODIMENTS

Figure 1:
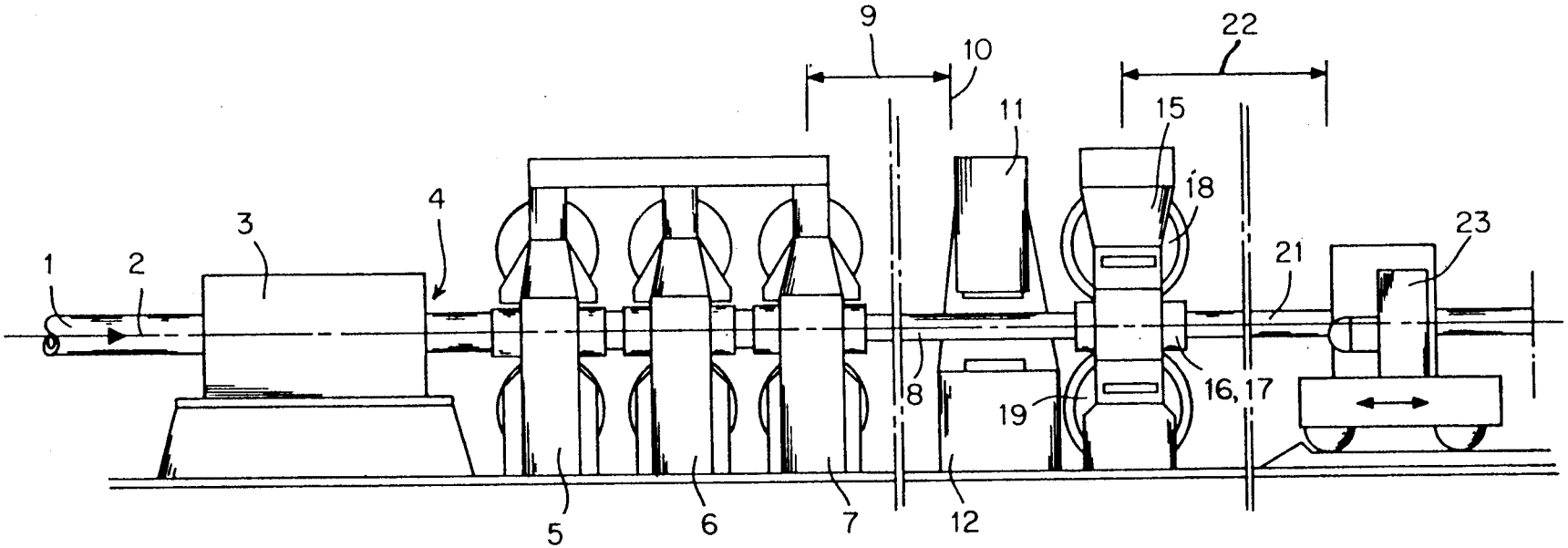

Welded round tubing 1 with a wall that is uniformly thick around its circumference is introduced in processing direction 2 into an induction-annealing system 3 that heats the tubing all the way through. The temperature of round tubing 1 is approximately 975° C. at exit 4.

Roller stands 5, 6, and 7 fabricate tubing 1 into box section 8 with a uniform wall thickness.

Box section 8 is cooled subject to standardizing conditions in a following cooling station 9 and has a temperature of 210° C. at the exit 10 therefrom.

Downstream in processing direction 2 are linear inductors 11 and 12, which heat the midsections of upper flange 13 and of lower flange 14 to a temperature of 920° C.

Box section 8 now enters an edger 15 that accommodates adjustable fabricating rollers 16 and 17 and fixed backing rollers 18 and 19.

Flanges 13 and 14 are edged and thickened perpendicular to the longitudinal axis 20 of the box section, and their edge length is shortened in edger 15.

Box section 21, with walls that differ in thickness, now enters a cooling station 22 wherein it is cooled to room temperature with air subject to standardizing conditions.

A floating saw 23 trims box section 21 to individual lengths.

FIG. 2 illustrates the structure and function of edger 15.

Adjustable fabricating rollers 16 and 17 are concavely surfaced to prevent the webs from buckling in. The rollers edge flanges 13 and 14, which travel through fixed backing rollers 18 and 19 such as to ensure that the height 24 of the box section with non-uniform wall thicknesses along the periphery is identical to that of the box section 8 with uniform wall thicknesses along the periphery and that flanges 13 and 14 are thickened as the result of mass displacement toward the longitudinal axis of the section.

We claim:

1. A method for fabricating from steel a rectangular section with a longitudinal axis and with walls of non-uniform thickness, comprising the steps: rolling circular tubing having a uniform wall thickness into a rectangular section with walls of uniform thickness, two oppositely facing walls of said rectangular section being flange portions and two oppositely facing walls of said rectangular section being web portions; generating a temperature difference of at least 600° C. between mid-sections of said flange portions and mid-sections of said web portions while all walls of said rectangular section having a uniform thickness so that said mid-sections of said flange portions are 600° C. hotter than said midsections of said web portions; edging and thickening said flange portions perpendicular to the longitudinal axis of said rectangular section; said flange portions having flange corner regions and an edge length; shortening said edge length by rollers; and cooling said rectangular section to standard conditions without creasing said flange portions; said midsections of said flange portions having a higher temperature than said flange corner regions at the beginning of said edging and thickening step, said flange corner regions receiving heat conducted from the midsections of said flange portions to equalize the temperature along said flange portions.

2. A method as defined in claim 1, including the step of heating said circular tubing to a temperature of 900° C. to 1050° C. before rolling said circular tubing into a rectangular section with walls of uniform thickness; cooling partially the midsections of said web portions to 200° C. to 450° C. for generating said temperature difference between midsections of said flange portions and midsections of said web portions.

3. A method as defined in claim 2, wherein said mid-sections of said web portions are cooled with water.

4. A method as defined in claim 2, wherein the mid-sections of said web portions are cooled with air.

5. A method as defined in claim 1, including the step of heating said circular tubing to a temperature of 990° C. to 1050° C. before rolling said circular tubing into a rectangular section with uniform wall thickness; cooling said rectangular section with walls of uniform thickness to standard conditions; and annealing partially the midsections of said web portions for generating said temperature difference between midsections of said flange portions and midsections of said web portions.

6. A method as defined in claim 5, including the step of trimming said circular tubing into separate lengths prior to said annealing step.

7. A method as defined in claim 5, including the step of trimming said rectangular section with uniform wall thickness into separate lengths prior to said annealing step.

8. A method as defined in claim 1, wherein said circular tubing is rolled into a rectangular section with walls of uniform thickness in said rolling step at room temperature; and annealing partially the midsections of said web portions for generating said temperature difference between midsections of said flange portions and midsections of said web portions.

9. A method as defined in claim 8, including the step of trimming said rectangular section with uniform wall thickness into separate lengths prior to said annealing step.

10. A method as defined in claim 8, including the step of trimming said circular tubing with uniform wall thickness into separate lengths prior to said annealing step.

* * * * *